US007696697B2

(12) United States Patent
Kuwahara et al.

(10) Patent No.: US 7,696,697 B2
(45) Date of Patent: Apr. 13, 2010

(54) MAGNETRON

(75) Inventors: Nagisa Kuwahara, Tochigi (JP); Takeshi Ishii, Tochigi (JP); Masayuki Aiga, Hyogo (JP)

(73) Assignee: Panasonic Corporation, Osaka (JP)

( * ) Notice: Subject to any disclaimer, the term of this patent is extended or adjusted under 35 U.S.C. 154(b) by 81 days.

(21) Appl. No.: 11/976,353

(22) Filed: Oct. 24, 2007

(65) Prior Publication Data

US 2008/0100221 A1 May 1, 2008

(51) Int. Cl.
*H01J 25/50* (2006.01)

(52) U.S. Cl. ..... 315/39.51; 315/39

(58) Field of Classification Search ..... 315/39, 315/39.51, 39.53, 39.63; 313/34–38, 42, 313/43

See application file for complete search history.

(56) References Cited

U.S. PATENT DOCUMENTS

| | | | | |
|---|---|---|---|---|
| 5,394,060 | A * | 2/1995 | Yoon | 315/39.51 |
| 6,633,131 | B2 * | 10/2003 | Murao et al. | 315/39.51 |
| 6,989,634 | B2 * | 1/2006 | Saitou et al. | 315/39.51 |
| 2007/0151847 | A1 * | 7/2007 | Lee | 204/298.19 |

FOREIGN PATENT DOCUMENTS

| | | |
|---|---|---|
| JP | 61-285637 | 12/1986 |
| JP | 63-010429 | 1/1988 |
| JP | 10-83765 | 3/1998 |
| JP | 2004-281320 | 10/2004 |
| JP | 2006-49119 | 2/2006 |

OTHER PUBLICATIONS

European Search Report issued in European Patent Application No. 07119172.0-2208 dated on May 15, 2008.
English Translation of Chinese Office Action issued in Chinese Patent Application No. CN 200710180268.8, dated Nov. 6, 2009.

* cited by examiner

*Primary Examiner*—Douglas W Owens
*Assistant Examiner*—Jimmy T Vu
(74) *Attorney, Agent, or Firm*—McDermott Will & Emery LLP

(57) ABSTRACT

In the magnetron, an upper end hat 122A is used as a composing element of a cathode structure member 12A and includes a portion 122Aa which is in contact with one end portion 121*a* of a filament coil 121. The thickness of the portion 122Aa is reduced, whereby the portion 122Aa is held not in contact with a center lead 124. Owing to this, heat generated in the filament coil 121 can travel to the upper end hat 122A without traveling directly to the center lead 124. Therefore, even when the quantity of input power is reduced to such a degree as to be able to reduce noise, or even when the electron radiation area of the filament coil 121 is reduced, the getter effect can be displayed fully. As a result of this, noise reduction and cost reduction can be realized at the same time.

3 Claims, 6 Drawing Sheets

PRIOR ART

PRIOR ART

MAGNETRON

BACKGROUND OF THE INVENTION

1. Field of the Invention

The present invention relates to a magnetron for use in a microwave using apparatus such as a microwave oven.

2. Description of the Related Art

Conventionally, there is proposed a technology which uses a getter for the purpose of enhancing the degree of vacuum in the inside of a magnetron (for example, see the patent reference 1). FIG. 5 is a longitudinal section view of a magnetron for use in a conventionally general microwave oven. In FIG. 5, in the inside of a cylindrical-shaped anode barrel member 10, there are radially arranged anode vanes 11; and, there are provided cavity resonators formed of spaces respectively enclosed by the mutually adjoining anode vanes 11 and anode barrel member 10. In the central portion of the anode barrel member 10, there is provided a cathode structure member 12; and, a space enclosed by the cathode structure body 12 and anode vanes 11 provides an action space 19.

The cathode structure member 12, as shown in FIG. 6 which is a partial section view of the cathode structure member 12, comprises: a filament coil 121 made of thorium tungsten; an upper end hat 122 and a lower end hat 123 respectively made of molybdenum for supporting the two end portions of the filament coil 121; a center lead 124 having a leading end portion fixed to the upper end hat 122 and penetrating through the lower end hat 123 in such a manner that it is not in contact with the filament coil 121; and, a side lead 125 the leading end of which is fixedly secured to the lower end hat 123. The filament coil 121 is fixed to the upper and lower end hats 122 and 123 by high frequency brazing. As the material of the filament coil 121, there is used the above-mentioned thorium tungsten and, in order to increase the quantity of emission of electrons, on the surface of the filament coil 121, there is provided a carbonized layer by applying a current to the filament coil 121 in a hydrocarbon system gas to thereby heat the filament coil 121. The current, which heats the filament coil 121, flows in order of the center lead 124, upper end hat 122, filament coil 121, lower end hat 123 and side lead 125 or in reverse order.

On the top surface of the upper end hat 122, there is disposed a getter 126 which is used to enhance the degree of vacuum of the inside of the magnetron. As known well, when a magnetron is operated, there is emitted a gas from the composing members of the magnetron and, due to the gas, the degree of vacuum of the inside of the magnetron is lowered and the oscillation efficiency of the magnetron is thereby lowered, which can raise a fear that the oscillation of the magnetron is caused stop. To solve this problem, by disposing the getter 126 made of titanium, zirconium or the like in the inside of the magnetron, the gas emitted from the composing members of the magnetron is absorbed to thereby prevent the lowered degree of vacuum.

By the way, the getter 126 may also be disposed on the lower end hat 123 instead of the upper end hat 122. Also, in the magnetron disclosed in the patent reference 1, the particle diameter of gas absorbing metal powder used as the getter 126 is set for 10 μm or smaller to thereby not only prevent the getter 126 from peeling off from the top surface of the upper end hat 122 but also enhance the getter effect.

Referring back to FIG. 5, to the upper end of the anode barrel member 10, there is fixed a pole piece 14; and, to the lower end thereof, there is fixed a pole piece 15. The pole pieces 14 and 15 are respectively formed in a funnel-like shape by drawing a plate member made of magnetic material having small magnetic resistance such as iron. In the pole piece 14, there is opened up a hole through which an antenna 16 can be passed. Just above the pole piece 14 and just below the pole piece 15, there are closely mounted ring-shaped magnets 17 each of which has a hollow central portion, respectively. Through the magnet 17 mounted just above the pole piece 14, there can be penetrated the antenna 16. As the magnet 17, from the viewpoint of reducing the size of the whole of the magnetron and making the magnetron easy to handle, there is used a ring-shaped permanent magnet using ferrite; and, one end portion of the magnet 17 is closely contacted with the pole piece 14(15). A yoke 18 is used to magnetically connect together the other end sides of the magnets 17 and the pole pieces 14 and 15, and the yoke 18 is made of a plate member having small magnetic resistance such as iron. That is, the upper and lower magnets 17 are respectively connected to the pole pieces 14 and 15 magnetically by the yoke 18.

The anode barrel member 10, together with the anode vanes 11 respectively formed in the inside thereof, is made of material such as oxygen-free copper which can radiate heat well and is hard to generate gas. The reason for this is that, when the following two facts are taken into consideration, a material which can provide good electric conduction and heat conduction is preferred: that is, one fact is that the material is heated by impacts generated when electrons fly into the leading end portions of the anode vanes 11; and, the other is that, when the anode vanes 11 and anode barrel member 10 cooperate together to form cavity resonators and, within the cavity resonators, microwaves are resonated and oscillated, a large amount of high frequency currents flow in the respective surfaces of the anode vanes 11 and anode barrel member 10.

When the conventional magnetron is used, the inside of the anode barrel member 10 is evacuated and a direct current high voltage is applied to and between the anode vanes 11 and cathode structure member 12. In the action space 19, there is formed a magnetic field due to two magnets 17. As the direct current high voltage is applied to and between the anode vanes 11 and cathode structure member 12, thermoelectrons discharged from the cathode structure member 12 fly out toward the anode vanes 11. At the then time, the magnetic field generated by the two magnets 17 concentrates in a gap formed between the pole pieces 14 and 15 and thus, in the action space 19, the magnetic field acts in a direction perpendicular to a direction where the cathode structure member 12 and anode barrel member 10 are opposed to each other. As a result of this, while the thermoelectrons discharged from the cathode structure member 12 are caused to circle due to a Lorentz force received from the magnetic field caused by the two magnets 17, they turn around the periphery of the cathode structure member 12 and then arrive at the anode vanes 11. Energy generated due to the then time electron motion is applied to the cavity resonators, which contributes to the oscillation of the magnetron.

Patent Reference: JP-A-2004-281320

By the way, in the case of a magnetron, since it discharges electrons in the inside thereof, when the quantity of electrons to be discharged is large, there increases noise. As a method for reducing the noise, there are available a method which reduces the quantity of input power (that is, which reduces the quantity of a current flowing in a filament coil to thereby lower the temperature of the filament coil and thus restrict the quantity of thermoelectrons to be discharged), and a method which changes the line diameter or pitch of a filament coil 121 to thereby reduce the electron discharge area of the filament coil 121. However, in both of these methods, a getter effect (that is, a gas sucking effect) cannot be displayed sufficiently.

In the conventional magnetron shown in FIGS. 5 and 6, a getter 126 is heated by heat discharged from the filament coil 121, whereby the getter effect can be displayed; however, when the quantity of the input power is reduced, it seems that the quantity of heat radiated from the filament coil 121 is reduced and thus the heating of the getter 126 becomes insufficient, which results in the lowered getter effect.

SUMMARY OF THE INVENTION

The present invention aims at solving the above problem and thus it is an object of the invention to provide a magnetron which, even when the quantity of heat radiated from the filament coil is reduced, can display the getter effect fully.

The above object can be attained by the following structures.

(1) A magnetron comprises: an anode barrel member having more than one vane projected toward the center axis direction thereof; and, a cathode structure member disposed on the center axis of the anode barrel member and forming an action space between the anode vanes and itself, wherein the cathode structure member includes a filament coil, upper and lower end hats respectively for supporting the two end portions of the filament coil, a center lead having a leading end portion fixed to the upper end hat and penetrating through the lower end hat while not in contact with the filament coil, and a getter disposed on the top surface of the upper end hat, wherein the portion of the upper end hat in contact with one end portion of the filament coil is held not in contact with the center lead.

(2) A magnetron as set forth in the above item (1), wherein the thickness of the portion of the upper end hat in contact with one end portion of the filament coil is formed small.

According to a magnetron as set forth in the above item (1), since the portion of the upper end hat in contact with one end portion of the filament coil is held not in contact with the center lead, heat generated in the filament coil can travel to the upper end hat without traveling directly to the center lead. Therefore, for example, even when the quantity of the input power is reduced to such a degree as to be able to reduce noise, or even when the electron radiation area of the filament coil is reduced whereby the quantity of heat radiated from the filament coil is reduced, the heat radiated from the filament coil can be supplied to the upper end hand with good efficiency, thereby being able to display the getter effect fully. Also, when the electron radiation area of the filament coil is reduced, the quantity of use of thorium tungsten, which is the main material of the filament coil, can be reduced, which makes it possible to lower the product price of the magnetron. Thus, according to the above-mentioned structure, while maintaining the getter effect to keep a good degree of vacuum, noise reduction and cost reduction can be realized.

According to a magnetron as set forth in the above item (2), since the portion of the upper end hat in contact with the filament coil is formed small, the portion of the upper end hat in contact with the filament coil can be kept not in contact with the center lead. Also, simply by adding a step of reducing the thickness of the above portion of the upper end hat to the conventional upper end hat manufacturing step, the present portion can be made not in contact with the center lead. Also, the quantity of use of molybdenum, which is the main material of the end hat, can be reduced to thereby be able to lower the product price of the magnetron.

Also, since a microwave using apparatus according to the invention includes a magnetron as set forth in the above item (1) or (2), in the present microwave using apparatus, not only noise reduction can be attained but also the product cost can be reduced.

DESCRIPTION OF THE PREFERRED EMBODIMENTS

Now, description will be given below in detail of a preferred mode for enforcing the invention with reference to the accompanying drawings.

Figure 1:
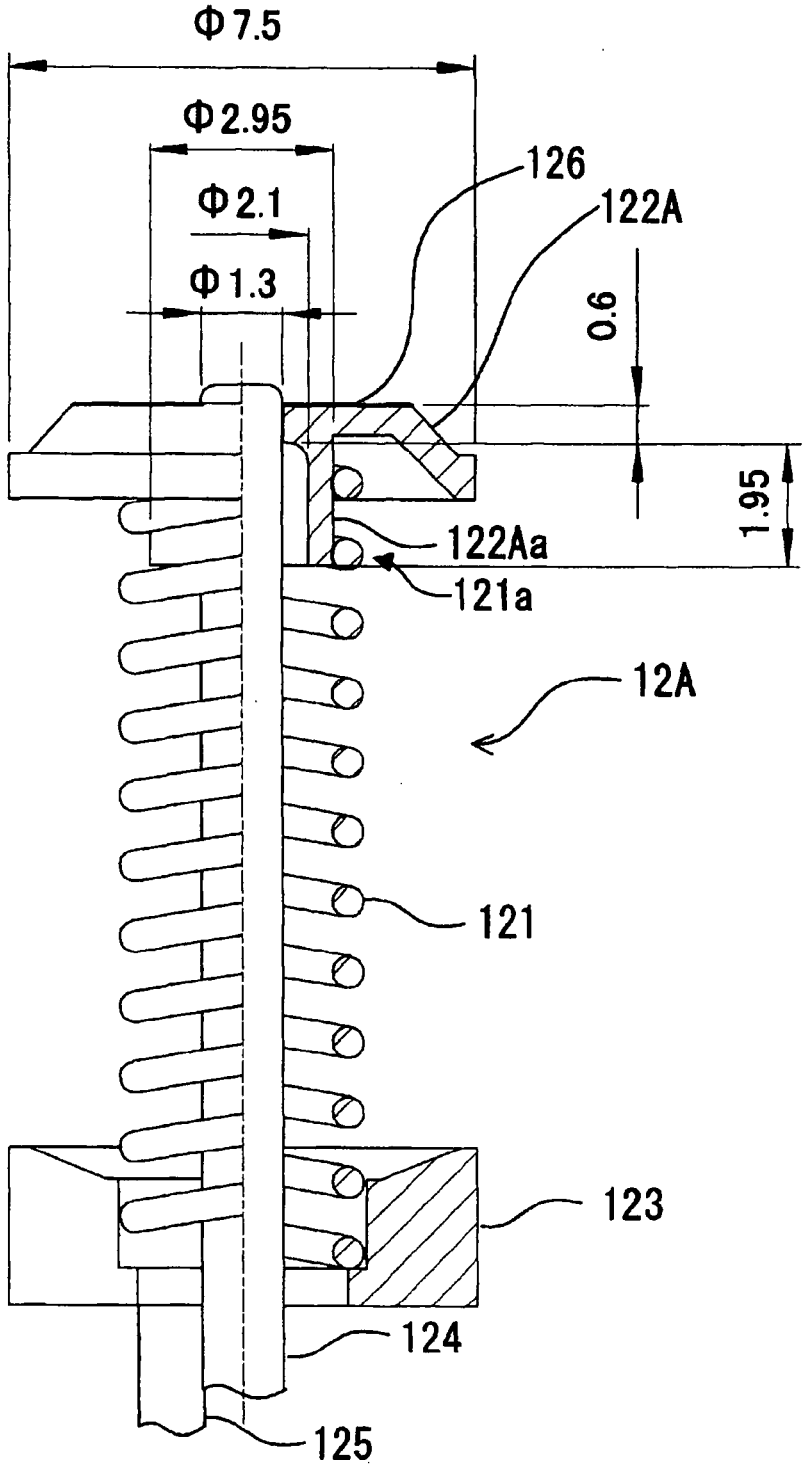
FIG. 1 is a partial section view of a cathode structure member used in a magnetron according to an embodiment of the invention.
Figure 5:
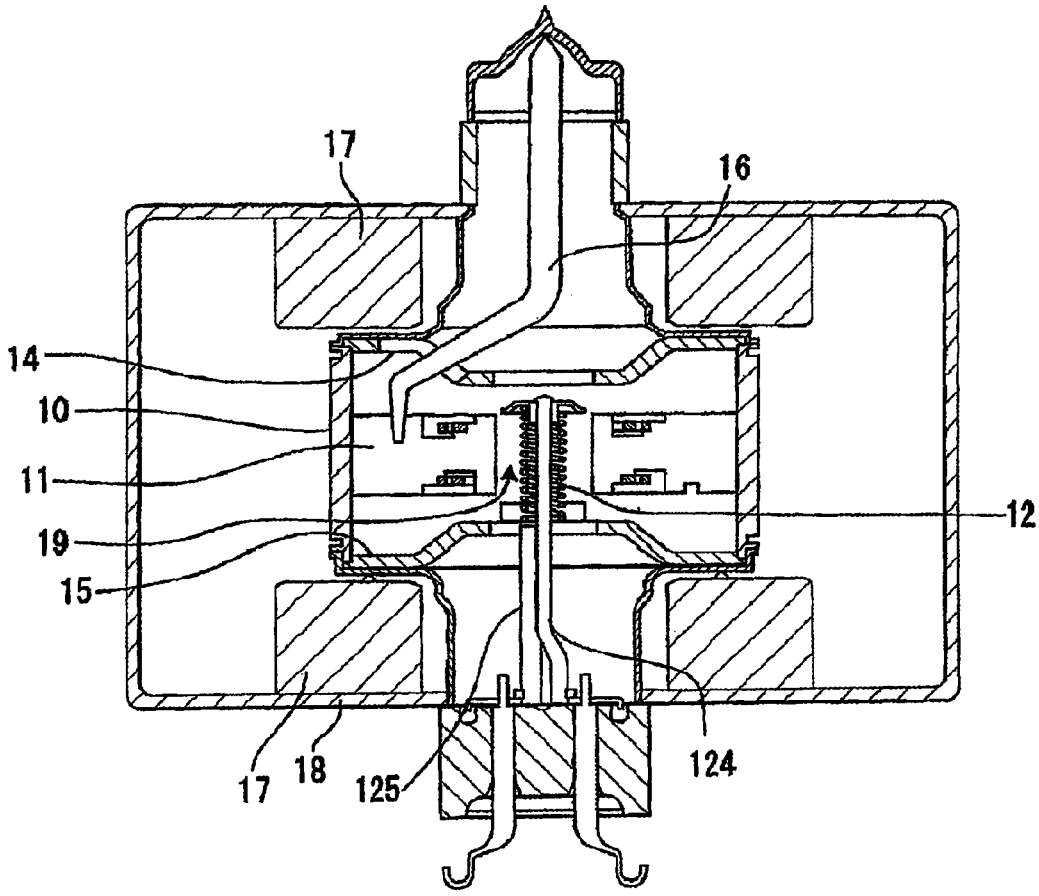
FIG. 5 is a longitudinal section view of the conventional magnetron.
Figure 6:
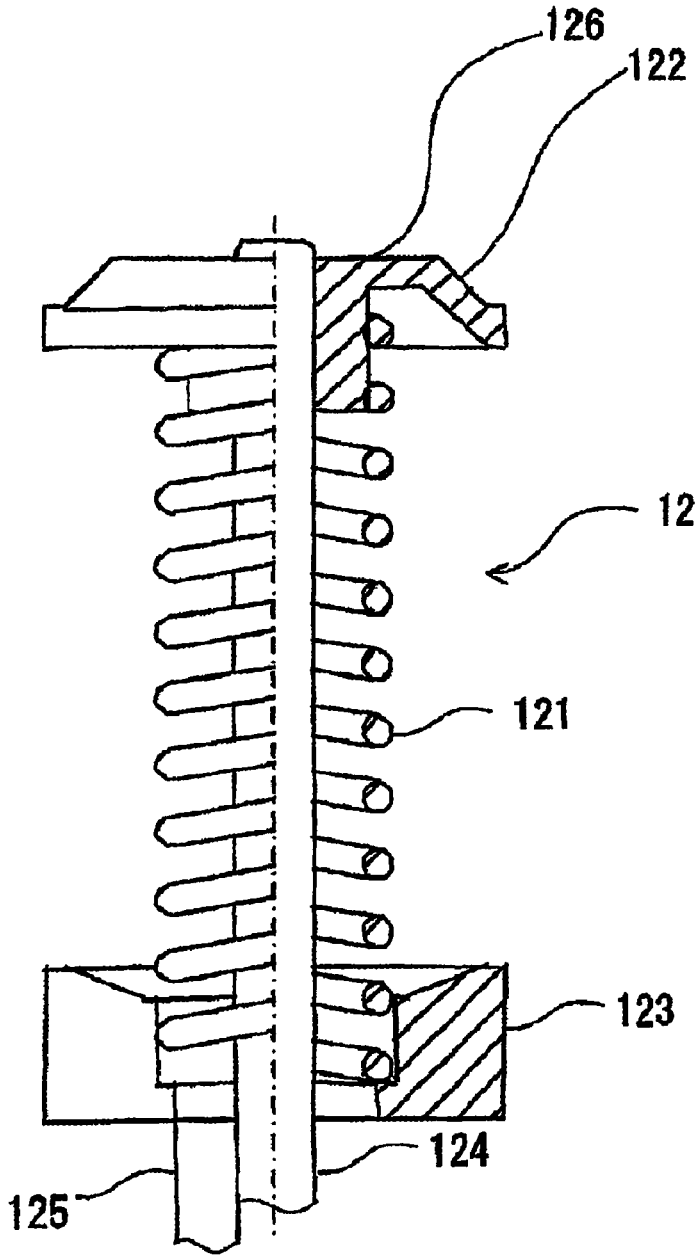
FIG. 6 is a partial section view of a cathode structure member employed in the conventional magnetron.

FIG. 1 is a partial section view of a cathode structure member used in a magnetron according to an embodiment of the invention. In FIG. 1, parts used in common with those of the cathode structure member 12 shown in the above-mentioned FIG. 6 are given the same designations. Also, a magnetron according to the present embodiment is similar in structure to the magnetron shown in FIG. 5 except for the cathode structure member and thus, when the need arises for the sake of explanation, FIG. 5 will be quoted.

In FIG. 1, a magnetron according to the present embodiment includes a cathode structure member 12A which, even when the quantity of input power is reduced to such a degree as to be able to reduce noise, or even when the electron radiation area of a filament coil 121 is reduced, can provide the temperature that allows a getter 126 to act with high efficiency. This cathode structure member 12A includes, besides the above-mentioned filament coil 121 and getter 126, upper and lower end hats 122A and 123 which are respectively used to support the two end portions of the filament coil 121, a center lead 124 which has a leading end portion fixed to the upper end hat 122A and penetrates through the lower end hat 123 while not in contact with the filament coil 121, and a side lead 125 which has a leading end portion fixed to the lower end hat 123, wherein the portion 122Aa of the upper end hat 122A in contact with one end portion 121*a* of the filament coil 121 is held not in contact with the center lead 124.

Figure 2A:
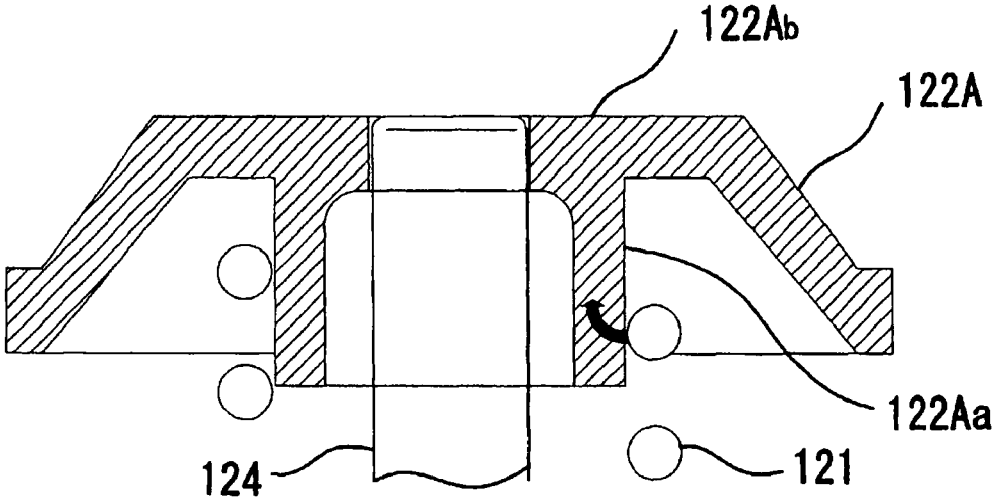
FIG. 2 is a longitudinal section view in which the shape of an upper end hat according to the present embodiment is compared with that of the conventional upper end hat.
Figure 2B:
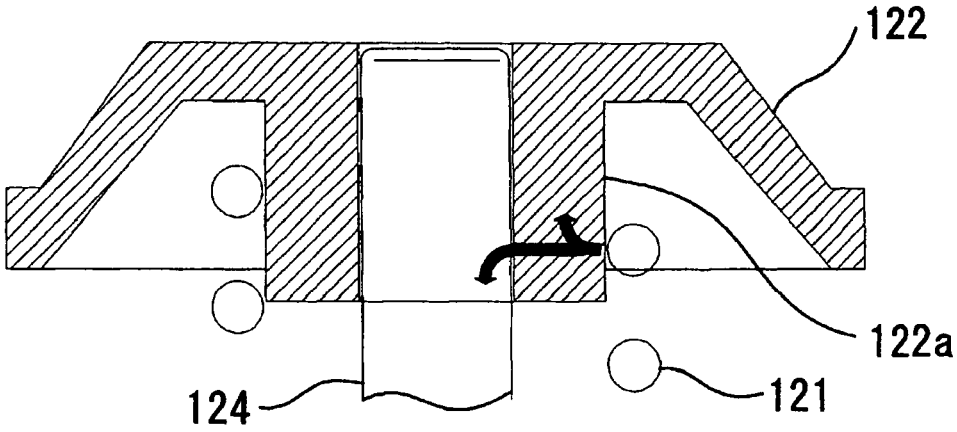

FIG. 2 is a longitudinal section view in which the shape of the upper end hat 122A according to the present embodiment is compared with that of the conventional upper end hat 122. Specifically, the thickness of the portion 122Aa of the upper end hat 122A according to the present embodiment (FIG. 2A) in contact with one end portion 121*a* of the filament coil 121 is formed smaller than that of the corresponding portion 122*a* of the conventional upper end hat 122A (FIG. 2B); and, the present portion 122Aa is held not in contact with the center lead 124. The axial-direction length of the portion 122Aa may be a length that allows the portion 122Aa to turn round the filament coil 121 at least one time. Also, the other portion

122Ab of the upper end hat 122A than the portion 122Aa (that is, the portion of the upper end hat 122A which is not in contact with one end portion 121 a of the filament coil 121) is similar in thickness to the conventional upper end hat; and, in the portion 122Ab, there is opened up a hole with which the leading end portion of the center lead 124 can be fitted, whereby the leading end portion of the center lead 124 can be fixedly secured to the portion 122Ab.

Owing to such arrangement that the portion 122Aa of the upper end hat 122A is not in contact with the center lead 124, as shown by an arrow mark in FIG. 2A, heat generated in the filament coil 121 does not travel directly to the center lead 124 but travels to the upper end hat 122A. After the heat travels to the upper end hat 122A, it then travels to the center lead 124. On the other hand, in the case of the conventional upper end hat 122, since the portion 122*a* of the upper end hat 122 is in contact with the center lead 124, as shown by an arrow mark in FIG. 2B, heat generated in the filament coil 121 travels to both of the center lead 124 and upper end hat 122.

That is, in the conventional magnetron, heat generated in the filament coil 121 travels to both of the center lead 124 and upper end hat 122, whereas, in the magnetron according to the present embodiment, substantially all of heat generated in the filament coil 121 travels to the upper end hat 122A. Since, in the magnetron according to the present embodiment, substantially all of heat generated in the filament coil 121 travels to the upper end hat 122A, a sufficient quantity of heat can be supplied to the getter 126, which allows the getter 126 to act with high efficiency. Owing to this, even when the quantity of input power is reduced to such a degree as to be able to reduce noise, or even when the electron radiation area of the filament coil 121 is reduced, not only the getter effect can be displayed sufficiently, but also noise reduction and cost reduction can be realized at the same time.

Figure 3:
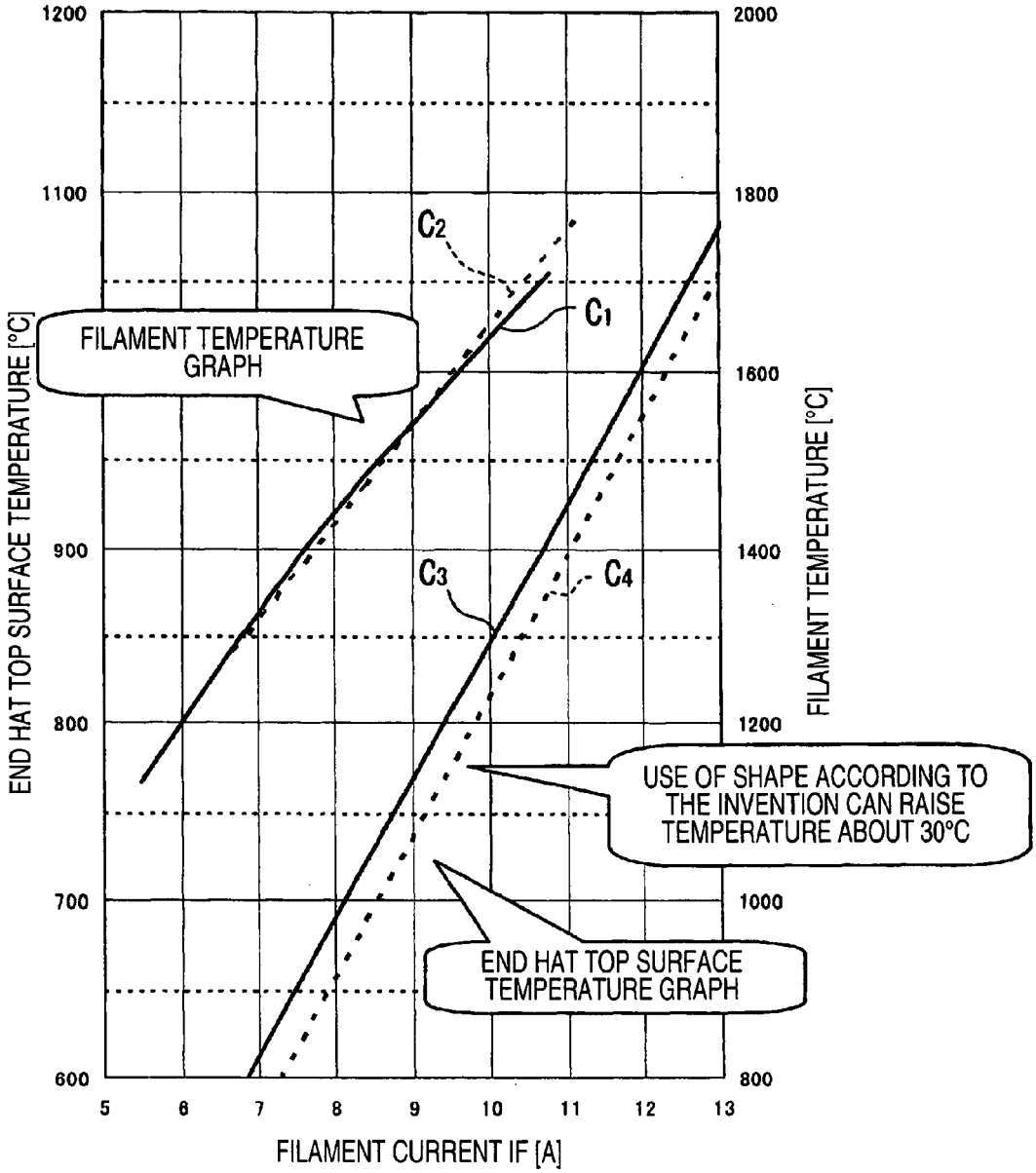
FIG. 3 is a graphical representation of an example of the results of the measured temperatures of the top surfaces of the end hats of the magnetron shown in FIG. 1 and conventional magnetron with respect to the filament temperatures thereof.

Here, in FIG. 3, there is shown an example of the results of the measured temperatures of the top surfaces of the end hats of the magnetron according to the present embodiment and the conventional magnetron with respect to the filament temperatures thereof. The dimensions of the upper end hat are as shown in FIG. 1. In this case, the conventional magnetron is similar in dimension to the magnetron according to the present embodiment except that its portion 122*a* corresponding to the portion 122Aa of the upper end hat 122A according to the invention is different in thickness. That is, the diameter of the umbrella-shaped portion is 7.5 mm, the thickness of the umbrella-shaped portion is 0.6 mm, the length of the portion 122Aa (122*a*) is 1.95 mm, the diameter of the portion 122Aa (122*a*) is 2.95 mm, the inside diameter of the portion 122Aa is 2.95 mm, and the diameter of the center lead 124 is 1.3 mm.

In FIG. 3, reference character C1 designates a graph which represents the filament temperatures of the magnetron according to the present embodiment, C2 a graph for representing the filament temperatures of the conventional magnetron, C3 a graph for representing the end hat top surface temperatures (the temperatures of the top surface of the upper end hat 122A) of the magnetron according to the present embodiment, and C4 a graph for representing the end hat top surface temperatures (the temperatures of the top surface of the upper end hat 122) of the conventional magnetron, respectively. As can be seen from the graphs C1 and C2, the filament temperatures are substantially similar in both the magnetron according to the present embodiment and the conventional magnetron, whereas the end hat top surface temperatures have risen about 30° due to use of the shape according to the present embodiment. That is, when the upper end hat is formed to have the shape according to the present embodiment, the end hat top surface temperatures can be raised over the conventional magnetron.

Figure 4:
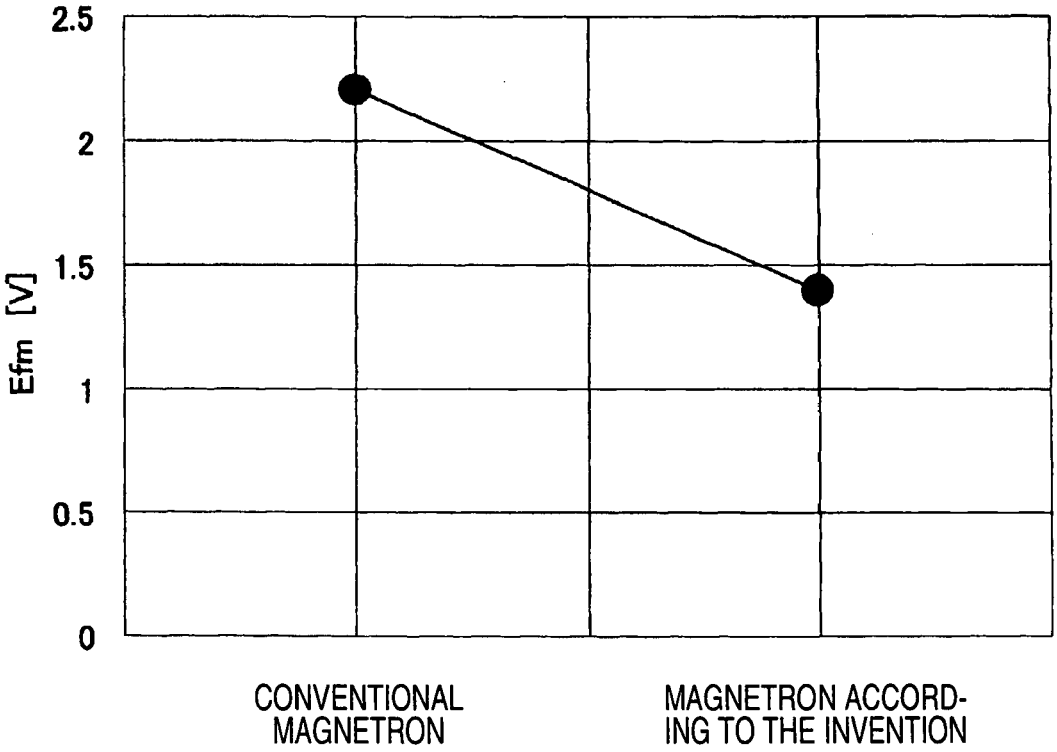
FIG. 4 is a graphical representation of an example of the Efm measured results of the magnetron shown in FIG. 1 and conventional magnetron.

FIG. 4 shows an example of the Efm measured results when the quantity of input power is reduced in the magnetron according to the present embodiment and in the conventional magnetron. Here, the term "Efm" means one of the characteristics of a magnetron and is the parameter that can tell whether the degree of vacuum is good or bad. As the degree of vacuum worsens, the Efm increases. The Efm of the conventional magnetron is 2.2 V, whereas the Efm of the magnetron according to the present embodiment is 1.4 V, which shows that the magnetron according to the present embodiment is better in the degree of vacuum than the conventional magnetron. Since the Efm value in the normal operation is about 1.4 V, it can be found that, according to the present embodiment, even when the filament input is reduced, the degree of vacuum can be maintained at a normal level.

As described above, according to the magnetron of the present embodiment, since the portion 122Aa of the upper end hat 122A in contact with one end portion 121*a* of the filament coil 121 is held not in contact with the center lead 124, heat generated in the filament coil 121 does not travel directly to the center lead 124 but travels to the upper end hat 122A. Therefore, even when the quantity of input power is reduced to such a degree as to be able to reduce noise, or even when the electron radiation area of the filament coil 121 is reduced, not only the getter effect can be displayed sufficiently, but also noise reduction and cost reduction can be realized at the same time.

Also, the partial non-contact state between the upper end hat 122A and center lead 124 is realized by reducing the thickness of the present portion 122Aa of the upper end hat 122A. And, such thickness reducing step may only be added to the conventional upper end hat manufacturing step, which makes it possible to minimize an increase in the manufacturing cost of the magnetron.

Although, in the above-mentioned embodiment, the partial non-contact state between the upper end hat 122A and center lead 124 is realized by reducing the thickness of the present portion 122Aa of the upper end hat 122A, in order to strengthen the fixation of the upper end hat 122A to the center lead 124, the thickness of the portion 122Aa can also be increased. In this case, it is necessary to redesign the dimensions of the other parts such as filament coil 121. And, it is possible to realize such redesign. Normally, the center lead 124 is used only to support the upper end hat 122A and one end of the filament coil 121, while the upper end hat 122A and filament coil 121 are light in weight; and, therefore, it can be said that only the other portion 122Ab of the upper end hat 122A than the portion 122Aa should be increased in thickness.

The invention can provide an effect that, even when the quantity of input power is reduced to such a degree as to be able to reduce noise, or even when the electron radiation area of the filament coil is reduced, there can be provided such temperatures as allow the getter to act with high efficiency and, therefore, the invention is useful in equipment using microwaves such as a microwave oven.

What is claimed is:

1. A magnetron, comprising:

an anode barrel member having more than one vane projected toward the center axis direction thereof; and a cathode structure member disposed on the center axis of the anode barrel member and forming an action space between the anode vanes and itself, wherein the cathode structure member includes a filament coil, upper and lower end hats respectively for supporting the two end portions of the filament coil, a center lead having a leading end portion fixed to the upper end hat and penetrating through the lower end hat while not in contact with the filament coil, and a getter disposed on the top surface of the upper end hat, wherein the portion of the upper end hat in contact with one end portion of the filament coil at a radial outside of the upper end hat is held not in contact with the center lead.

2. The magnetron as set forth in claim 1, wherein the thickness of the portion of the upper end hat in contact with one end portion of the filament coil is formed small.

3. A microwave using apparatus, comprising a magnetron as set forth in claim 1.

* * * * *

UNITED STATES PATENT AND TRADEMARK OFFICE

CERTIFICATE OF CORRECTION

PATENT NO. : 7,696,697 B2
APPLICATION NO. : 11/976353
DATED : April 13, 2010
INVENTOR(S) : Nagisa Kuwahara et al.

It is certified that error appears in the above-identified patent and that said Letters Patent is hereby corrected as shown below:

ON THE TITLE PAGE OF THE PATENT:

Insert Item -- (30) Foreign Application Priority Data

October 25, 2006 (JP).....2006-289753 -- after "PRIOR PUBLICATION DATA"

and prior to "(51) INT. CL."

Signed and Sealed this

Sixteenth Day of November, 2010

David J. Kappos

David J. Kappos
*Director of the United States Patent and Trademark Office*